US006571075B2

(12) United States Patent
Nakashima et al.

(10) Patent No.: US 6,571,075 B2
(45) Date of Patent: May 27, 2003

(54) LIQUID DEVELOPING ELECTROPHOTOGRAPHIC DEVICE

(75) Inventors: Yutaka Nakashima, Kanazawa (JP); Akihiko Inamoto, Uchinada-machi (JP); Shigeki Uesugi, Unoke-machi (JP); Satoru Moto, Kanazawa (JP); Masanari Takabatake, Kanazawa (JP); Motoharu Ichida, Tsubata-machi (JP); Shigeharu Okano, Hakui (JP); Seiichi Takeda, Kanazawa (JP); Tadashi Nishikawa, Tsubata-machi (JP); Satoshi Miyamoto, Hakui (JP); Hitoshi Terashima, Kanazawa (JP); Satoshi Sakai, Kanazawa (JP), onaga; Hironaga Hongawa, Uchinada-machi (JP); Masanobu Hongo, Unoke-machi (JP); Hideaki Shibata, Kanazawa (JP); Yasuhiko Kishimoto, Uchinada-machi (JP); Tatsuo Nozaki, Kanazawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 10/009,716

(22) PCT Filed: May 15, 2001

(86) PCT No.: PCT/JP01/04016

§ 371 (c)(1),
(2), (4) Date: Dec. 14, 2001

(87) PCT Pub. No.: WO01/88630

PCT Pub. Date: Nov. 22, 2001

(65) Prior Publication Data

US 2002/0159794 A1 Oct. 31, 2002

(30) Foreign Application Priority Data

May 15, 2001 (JP) ..... 2000-142880

(51) Int. Cl.[7] ..... G03G 15/10

(52) U.S. Cl. ..... 399/237; 399/239

(58) Field of Search ..... 399/237, 239, 399/240; 430/117, 119

(56) References Cited

U.S. PATENT DOCUMENTS 4,024,838 A * 5/1977 Horie ..... 399/239

FOREIGN PATENT DOCUMENTS

| | | | |
|---|---|---|---|
| JP | 8-254892 | | 10/1996 |
| JP | 8-328379 | | 12/1996 |
| JP | 09-062109 | | 7/1997 |
| JP | 11-174852 | | 7/1999 |
| JP | 11-194622 | | 7/1999 |
| JP | 11-194623 | | 7/1999 |
| JP | 11-344865 | * | 12/1999 |
| JP | 2000-15784 | * | 1/2000 |
| JP | 2000-89576 | * | 3/2000 |
| JP | 2001-13793 | * | 1/2001 |

* cited by examiner

*Primary Examiner*—Sophia S. Chen

(57) ABSTRACT

Provided are an applicator roller for conveying and applying liquid toner onto a developing roller in the form of a level, thin layer, and a conductive blade which comes into contact with a liquid toner layer on the developing roller. A predetermined amount of liquid toner passes through a gap between the conductive blade and the developer roller; and voltage is applied to the conductive blade so as to establish a state such that toner particles contained in the liquid toner are sparsely scattered in a surface region of a level, thin toner layer on the developing roller. Subsequently, the liquid toner, whose surface region is in a state such that toner particles are sparsely scattered, is brought into contact with an image bearer body for performing development.

13 Claims, 4 Drawing Sheets

LIQUID DEVELOPING ELECTROPHOTOGRAPHIC DEVICE

TECHNICAL FIELD

The present invention relates to a liquid-development electrophotographic apparatus which uses a high-viscosity, high-concentration liquid toner, and more particularly, to a liquid-development electrophotographic apparatus in which an oil layer of low solid concentration is formed at a surface region of a toner layer on a developing roller before development is performed.

BACKGROUND ART

FIG. 4 shows the overall configuration of a conventional liquid-development-type electrophotographic apparatus (as disclosed in, for example, Japanese Patent Application Laid-Open (kokai) No. 11-174852). An illustrated photosensitive drum 10 is electrostatically charged by means of a charger 21. Subsequently, the photosensitive drum 10 is exposed to light by means of an exposure unit 22, whereby an electrostatic latent image is formed. A prewetting unit 23 applies to the surface of the photosensitive drum 10 silicone oil having a viscosity of about 2.5 cSt to a thickness of 4–5 $\mu$m.

Developing units 24 corresponding to yellow, magenta, cyan, and black are provided, and use as a liquid developer a nonvolatile, high-viscosity, high-concentration liquid toner having a toner viscosity of 400–4000 mPa-S and a carrier viscosity of 20 cSt. Abutting the photosensitive body, a developing roller supplies the liquid developer onto a photosensitive body so as to maintain on the photosensitive body a two-layer structure composed of the liquid developer and prewetting liquid, and causes toner particles contained in the liquid developer to adhere to the photosensitive body according to an electric field established between the same and the photosensitive body.

Developer applicator means conveys the liquid developer from a toner fountain to a developing roller while spreading the liquid toner thinner, to thereby form on the developing roller a toner layer having a thickness of 2–3 $\mu$m. The developer applicator means includes a train of rotative rollers and conveys the liquid developer such that the liquid developer is applied to the surface of the rotative rollers while being spread. A final-stage rotative roller abuts a developing roller to thereby apply a liquid developer film, which is formed on the surface thereof, to the surface of the developing roller.

An intermediate transfer roller 15 is biased at about −800 V and transfers toner from the photosensitive drum 10 sequentially; for example, in the order of yellow, magenta, cyan, and black, according to an electric field established between the same and the photosensitive drum 10. A pressure roller 19 is adapted to fix on a printing medium toner which is melted on the intermediate transfer roller 15 by means of a heating unit 28. The heating unit 28 partially heats the surface of the intermediate transfer roller 15 at a position located upstream of a position where the intermediate transfer roller 15 comes into contact with the pressure roller 19. Reference numeral 26 denotes a blade for scraping off residual toner, and reference numeral 27 denotes a destaticizer.

In order to suppress fogging at a non-image area, which would otherwise occur as a result of viscous adhesion of toner fluid, a developing unit which uses a high-viscosity, high-concentration liquid toner requires a prewetting process for applying an insulating liquid to a photosensitive drum before development is performed.

In a known technique, voltage is applied between an applicator roller and a developing roller in order to apply a high-viscosity toner to a developing roller in the form of a thin toner layer. Also, there has been proposed a technique of applying an electric field to a developing roller in order to create a state in which toner particles have cohered (refer to Japanese Patent Application Laid-Open (kokai) No. 9-62109).

However, when a high-viscosity, high-concentration liquid toner is used, stress induced by viscosity of the toner liquid is very large as compared with an electrostatic force which causes toner particles to move. As a result, at the time of destructive separation at a toner conveyance section and a development section, a layer is disturbed greatly, with a resultant involvement of the following problems: poor levelness of a formed layer, impairment in image uniformity, and tendency of fogging. Application of a bias enables establishment of a state in which toner particles have been collected on the developing roller side at the nip section by means of an electric field. However, at the separation section, which is the exit of the nip section, viscosity of the toner liquid causes disturbance of toner.

Also, application of an electric field of high intensity enables cohesion of toner which can overcome viscosity. However, an excessively high degree of cohesion causes strong adhesion of toner to a developing roller, resulting in impairment in development density or a failure to collect residual toner after development.

DISCLOSURE OF THE INVENTION

An object of the present invention is to obtain a high-quality image in a configuration which uses a high-viscosity, high-concentration liquid toner, by imparting the following features to the configuration: an electric field is applied beforehand to a toner layer on a developing roller to thereby form at a surface region of the toner layer an oil layer of low solid concentration; an unnecessarily high degree of toner cohesion is not caused, and disturbance of the toner layer due to liquid viscosity is suppressed, to thereby form a level, transparent oil layer at a surface region of the toner layer; and the resultant toner layer is brought into contact with an image bearer body to thereby perform development.

Another object of the present invention is to apply a thin toner layer uniformly at a position located upstream of a member for applying an electric field, to thereby perform development effectively.

Still another object of the present invention is to avoid layer disturbance which would otherwise be caused by viscosity of toner at an exit of a nip section where a developing roller and a photosensitive drum effect nipping, to thereby obtain an image of high quality.

A liquid-development electrophotographic apparatus of the present invention comprises a developer bearer body which is in contact with an image bearer body having an electrostatic latent image formed thereon so as to supply a liquid toner serving as a liquid developer onto the image bearer body and which causes toner particles contained in the liquid developer to adhere to the image bearer body according to an electric field established between the same and the image bearer body to thereby form a toner image. The apparatus further comprises means for conveying and applying the liquid toner onto the developer bearer body in the form of a level, thin layer, and a conductive blade which comes into contact with a liquid toner layer on the developer bearer body. A predetermined amount of liquid toner is allowed to pass through between the conductive blade and the developer bearer body. Voltage is applied to the conductive blade so as to bring a surface region of the level, thin toner layer on the developer bearer body to a state such that toner particles contained in the liquid toner are sparsely scattered. The resultant liquid toner, whose surface region is in a state such that toner particles are sparsely scattered, is brought into contact with the image bearer body for performing development.

BEST MODE FOR CARRYING OUT THE INVENTION

Embodiments of the present invention will next be described in detail. The present invention uses a nonvolatile, high-viscosity, high-concentration liquid toner as a liquid developer. The liquid toner is composed of a liquid carrier (oil) and solid particles, which are formed of pigment, resin, etc. and dispersed in the liquid carrier. Preferably, the liquid toner uses silicone oil having a viscosity of 2.5 cSt-1000 cSt as a carrier agent and contains a solid component in an amount of not less than 5% and not greater than 40%.

Figure 1:
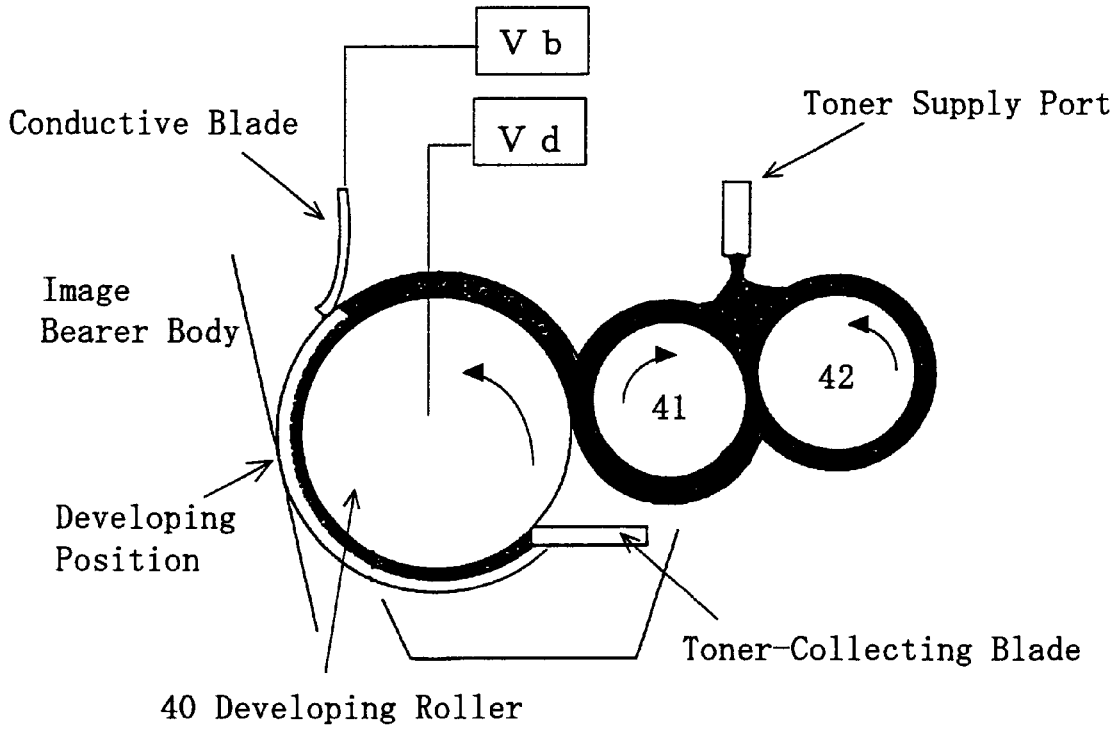
FIG. 1 is a view for explaining the action of a first embodiment of a developing unit that embodies the present invention.

FIG. 1 is a view for explaining the action of a first embodiment of a developing unit that embodies the present invention. FIG. 1 shows a developing roller 40—which is a developer bearer body and is in contact with a photosensitive body, or an image bearer body, capable of assuming the form of a drum or belt—and two applicator rollers 41 and 42 for supplying a developer to the developing roller 40.

The developing roller 40 supplies a liquid developer onto an image bearer body while being in contact with the image bearer body, and causes positively charged toner particles contained in the liquid developer to adhere to the surface of the image bearer body according to an electric field established between the same and the image bearer body. The applicator roller 41 spreads, into a level, thin layer, the liquid developer supplied to a nip section where the same and the applicator roller 42 effect nipping, to thereby apply the layer onto the surface of the developing roller 40.

The developing roller 40 is equipped with a conductive blade, which serves as the conductive member and comes into contact with the level, thin liquid toner layer. The conductive blade is formed of a conductive rubber material having a volume resistivity of not less than $10^3$ Ωcm and not greater than $10^8$ Ωcm. The conductive blade has appropriate flexibility and can be brought into contact with the developing roller such that an end surface thereof is in contact with the developing roller while being postured along the rotational direction of the developing roller, at such a pressure as to allow the flow of a liquid toner having, for example, a predetermined viscosity of 50 cSt–5000 cSt in an amount of, for example, 1 μm–50 μm.

Voltage is applied to the conductive blade. For example, voltage of the same polarity as that of toner polarity; specifically, a bias voltage of +1300 V, can be applied to the conductive blade with respect to a development bias voltage of +450 V applied to the developing roller 40. The bias voltage causes toner particles on the developing roller to which the corresponding bias voltage is applied, to move toward the surface of the developing roller; i.e., to move to a lower region of a toner layer. As a result, carrier liquid moves to a surface region of the toner layer. In other words, the surface region of the toner layer on the developing roller is in a state such that toner particles are sparsely scattered.

Preferably, development is performed before the toner particles that are biased as a result of application of the bias voltage to the conductive blade are restored to an original state thereof. That is, preferably, the conductive blade is disposed as close to a development position as possible; for example, such that travel time is not longer than 1 second, preferably not longer than 0.1 second.

When the toner layer on the developing roller comes into contact with the image bearer body to thereby perform development, a region of the toner layer which comes in direct contact with the image bearer body is a surface region of the toner layer; i.e., carrier liquid in which toner particles are sparsely scattered.

As described previously in the BACKGROUND ART section, in order to suppress fogging at a non-image area, which would otherwise occur as a result of viscous adhesion of toner fluid, insulating liquid (prewetting liquid) can be applied onto the image bearer body before development is performed. However, according to the present invention, as described above, since a region of the toner layer which comes in direct contact with the image bearer body is a surface region of the toner layer; i.e., carrier liquid in which toner particles are sparsely scattered, the carrier liquid serves as the conventionally used prewetting liquid. Thus, the present invention does not necessarily require prewetting liquid.

Figure 2:
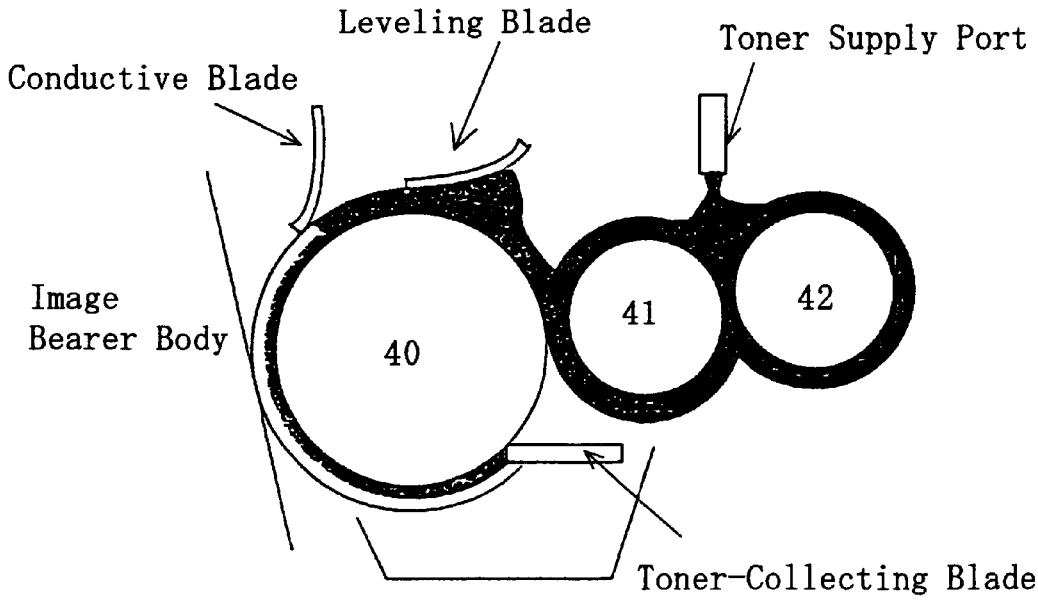
FIG. 2 is a view for explaining the action of a second embodiment of a developing unit that embodies the present invention.

FIG. 2 is a view for explaining the action of a second embodiment of a developing unit that embodies the present invention, the developing unit of FIG. 2 differing from that of FIG. 1. In FIG. 2, a leveling blade is disposed upstream of a conductive blade. The leveling blade is intended to level a thin toner layer and formed of, for example, insulating urethane rubber. By means of flexibility and contact pressure thereof, the leveling blade can limit liquid toner to a predetermined amount and can form the liquid toner into a level layer, whereby the resultant level layer reaches the conductive blade.

Figure 3:
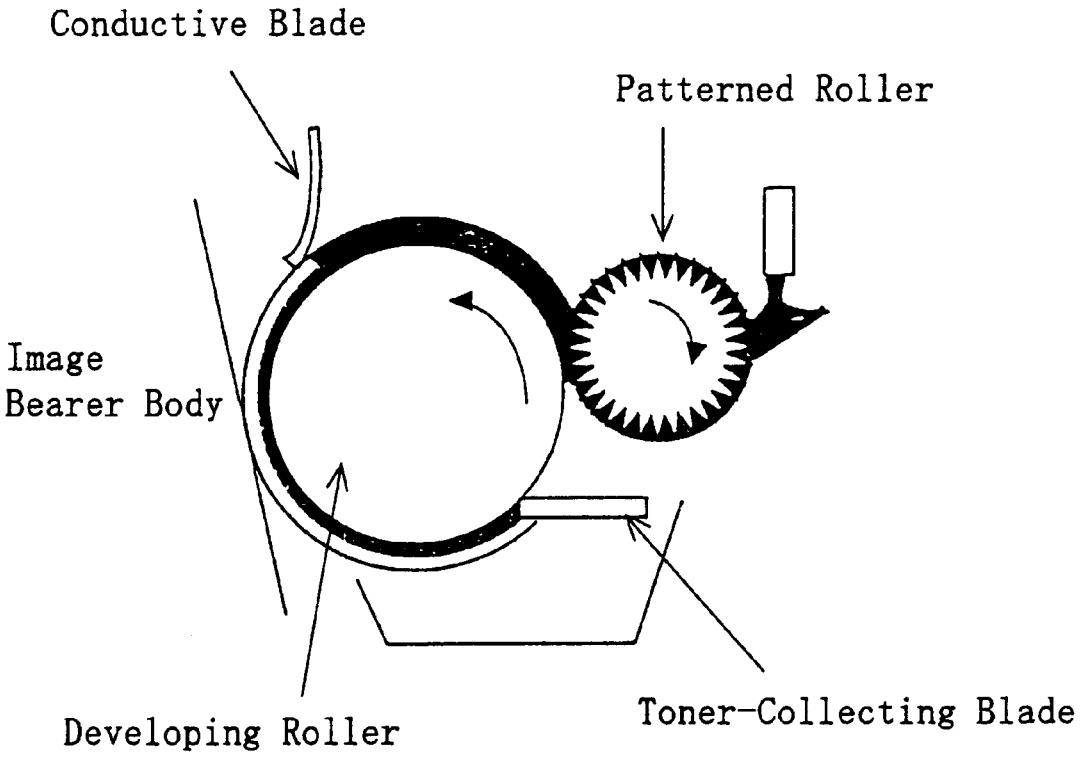
FIG. 3 is a view for explaining the action of a third embodiment of a developing unit that embodies the present invention.
Figure 4:
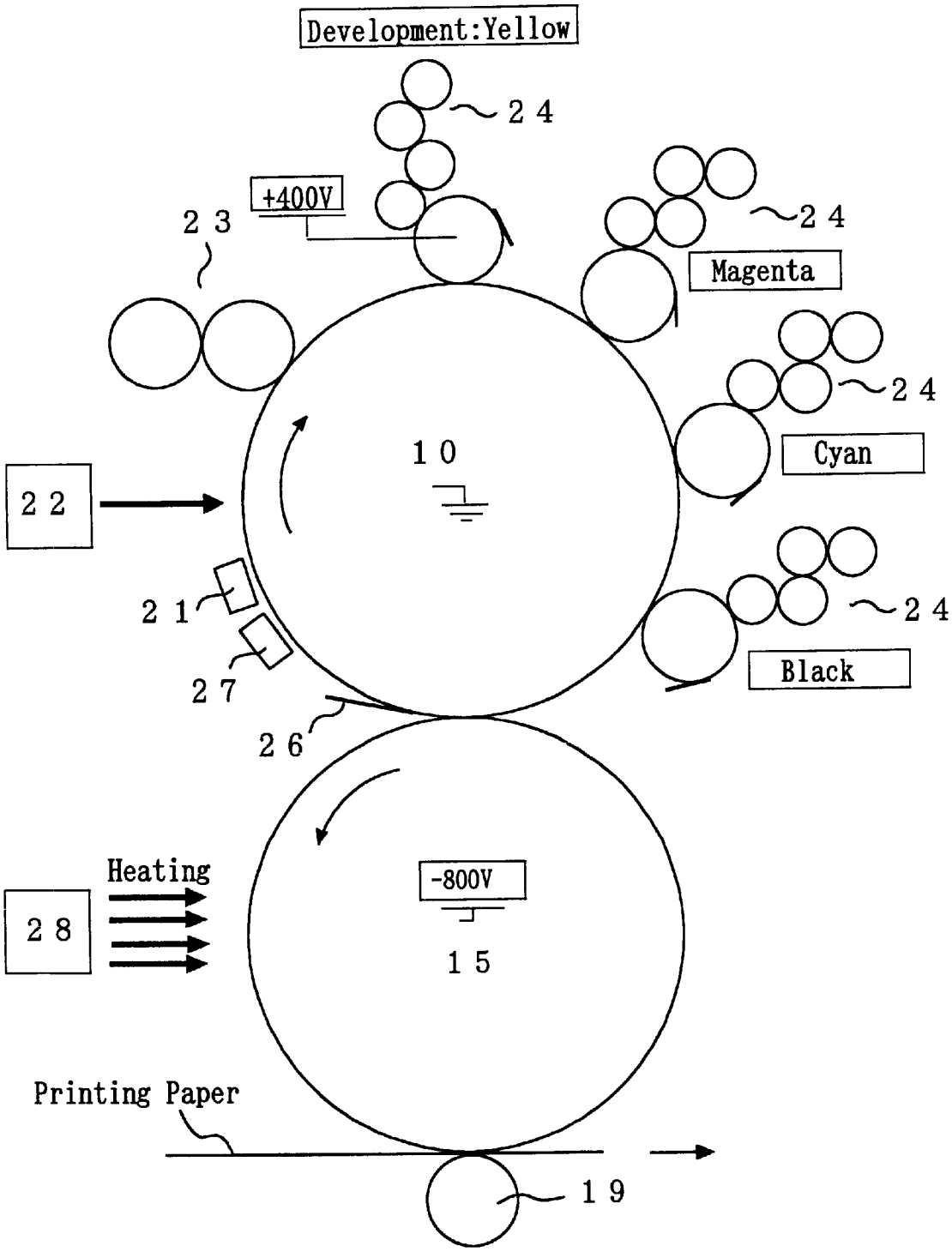
Fig.4 Prior Art
FIG. 4 is a view showing an overall configuration of a conventional liquid-development-type electrophotographic apparatus.

FIG. 3 is a view for explaining the action of a third embodiment of a developing unit that embodies the present invention, the developing unit of FIG. 3 differing from those of FIGS. 1 and 2. In FIG. 3, a patterned roller for conveying and supplying liquid toner onto a developing roller is located upstream of the developing roller in an abutting condition. A conductive blade comes into contact with a toner layer which has been supplied to the developing roller from the patterned roller. Very fine patterns are formed on the surface of the patterned roller. For example, a roller capable of being used in gravure printing or an "Anilox Roller" produced by Asahi Roller Co., Ltd. can be used as the patterned roller.

Through use of the patterned roller, liquid toner can be conveyed at a constant rate.

Figure 5:
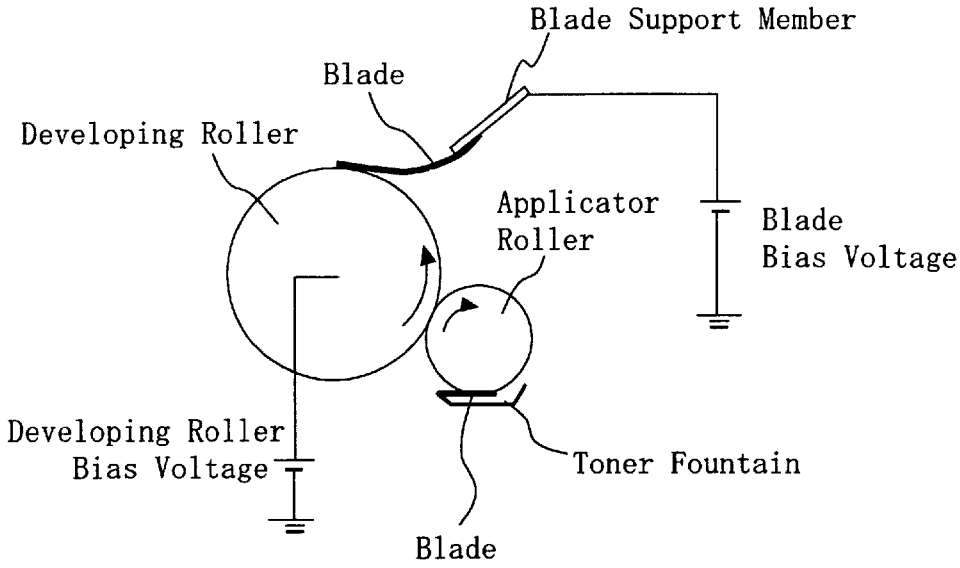
FIG. 5 is a view for explaining the action of a fourth embodiment of a developing unit that embodies the present invention.

FIG. 5 is a view for explaining the action of a fourth embodiment of a developing unit that embodies the present invention. Liquid toner is supplied to a toner fountain from an unillustrated toner storage tank or a toner supply bottle by use of a pump or the like. The liquid toner in the toner fountain is caused to adhere to the surface of an applicator roller. The applicator roller abuts a developing roller and rotates, to thereby supply the liquid toner onto the developing roller while thinly spreading the liquid toner. Since the liquid toner is used as a liquid developer, the liquid toner is applied onto the developing roller in the form of a thin layer having a thickness of 1–50 $\mu$m. The thus-applied liquid toner is conveyed to a development gap section, which is a contact section between the developing roller and an unillustrated photosensitive drum, whereby development is performed. The liquid developer which has passed through the development gap section and remains on the developing roller is scraped off by means of a toner collection blade (not shown) and is then returned to the toner storage tank.

Preferably, the developing roller has a resistance of $10^5$–$10^8$ Ω, a hardness of JIS A20°–60°, and a surface roughness of Rz 1–5 $\mu$m. When the resistance of the developing roller is excessively high, image density drops. When the photosensitive drum has a defect, such as a scratch, an excessively low resistance causes current leakage. As a result, a blank in an image occurs not only at a portion of the image corresponding to the scratch but also along the nip section. The resistance of a conductive blade is preferably $10^3$–$10^4$ Ω, and a bias can be applied to the conductive blade from a blade support member. Thus, voltage can be uniformly applied to a toner layer on the developing roller.

Figure 6:
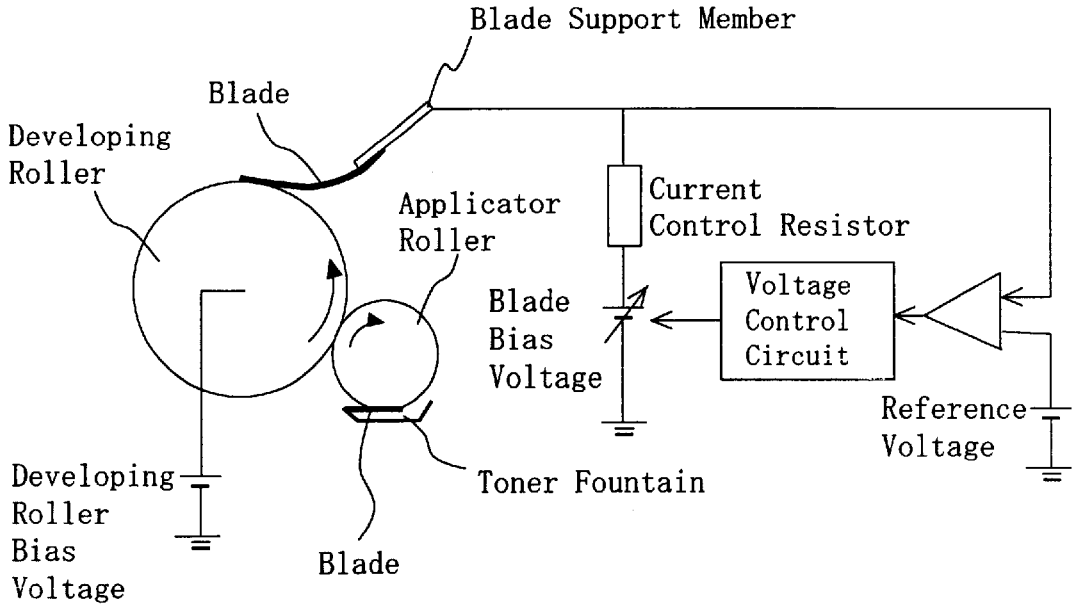
FIG. 6 is a view for explaining the action of a fifth embodiment of a developing unit that embodies the present invention.

As shown in FIG. 6, which shows still another embodiment of a developing unit, a current limiter resistor (e.g., about $10^6$ Ω) can be provided between a developing roller and a power supply in order to prevent damage to the developing roller which would otherwise result from overcurrent. A voltage drop across the current limiter resistor associated with blade bias current which varies with the resistance of toner is checked through comparison with a reference voltage. Based on the check result, the bias voltage can be varied such that an effective voltage to be applied to toner present between the blade and the developing roller is constant at all times. Also, through checking of variation with temperature in resistance of the conductive blade or variation in blade current according to movement characteristics of toner, a blade bias can be varied such that constant blade current flows. Notably, when a bias voltage of, for example, about 600 V is applied to the developing roller, a bias voltage having the same polarity as that of toner; for example, a bias voltage of about +1200 V to +1600 V can be applied to the blade.

When the developing roller has a defect, such as a scratch, current leaks from the defect. As a result, a blade bias voltage drop occurs, causing a failure to apply a sufficient bias to a toner layer. Impartment of a volume resistivity of $10^8$–$10^9$ Ωcm to the conductive blade can prevent a blade bias voltage drop which would otherwise occur across the overall blade width (along a direction orthogonal to the rotational direction of the developing roller) due to current leakage induced by a defect on the developing roller. Through applying a conductive coating of low resistance (e.g., a carbon-containing adhesive) onto the back surface of the conductive blade, voltage is uniformly applied from the blade support member, whereby voltage can be stably applied to a portion of the conductive blade in the vicinity of a contact portion of the conductive blade.

The blade is formed of a film having a thickness of 50–100 $\mu$m so as to assume sufficient flexibility, and an end portion of the blade is brought into contact with the developing roller, thereby providing a sufficient nip length of about 2 mm. Thus, it is at the tip end of the blade that the blade may be brought into contact with a toner layer on the developing roller so as to cut the toner layer, but not to scrape the toner layer. A blade film is made of, for example, polyimide, whose thermal expansion is low. Through employment of the above configuration, a riblet-free, level toner cohesion layer and a carrier layer are formed on the developing roller at a position located downstream of the blade. If a belly portion of a blade comes into contact with the developing roller to thereby cause separation of a toner layer beginning from the contact position and separating with the rotation of the developing roller, toner undergoes destructive separation within the toner layer at the exit of the nip section where the blade and the developing roller contact to effect nipping, causing occurrence of riblets. The force of an electric field established through application of bias cannot suppress the occurrence of riblets. By contrast, the blade of the present invention is formed of a flexible film and configured such that, when the toner layer on the surface of the developing roller separates from the blade as a result of rotation of the developing roller, the separation starts from the tip end of the blade. Therefore, it becomes possible to provide a sufficient nip length and allow the passage of a toner layer on the developing roller without the toner layer being scraped.

A bias voltage applied to the developing roller causes toner particles to move toward the surface of the developing roller; i.e., to move to a lower region of a toner layer. As a result, carrier liquid moves to a surface region of the toner layer. In other words, the surface region of the toner layer on the developing roller is in a state such that toner particles are sparsely scattered.

When the above-described toner layer on the developing roller comes into contact with a photosensitive body so as to perform development, a portion of the toner layer which comes in direct contact with the photosensitive body is carrier liquid which occupies a surface region of the toner layer and in which toner particles are sparsely scattered. Since the carrier liquid functions similarly as does insulating liquid (prewetting liquid) which is applied onto the photosensitive body before development is performed, the present invention can suppress fogging at a non-image area, which would otherwise occur as a result of viscous adhesion of toner fluid, without use of prewetting liquid.

A patterned roller is used as an applicator roller for supplying liquid toner onto the developing roller. Toner is drawn from a toner fountain onto the patterned roller. A blade in contact with the patterned roller scrapes off excessive toner such that toner is held merely in pattern grooves. Toner held in the pattern grooves is transferred to the developing roller at a contact section between the developing roller and the patterned roller. If, due to insufficient scrape, toner is present not only in the pattern grooves but also on ridges, toner will undergo destructive separation within a toner layer at the exit of a nip section where the patterned roller and the developing roller contact to effect nipping, causing occurrence of riblets. When toner is held merely in the pattern grooves, toner is transferred at the exit of the nip section while undergoing destructive separation; however, since toner is divided according to pattern, streaky riblets do not occur continuously. Thus, toner is transferred onto the developing roller according to pattern on the patterned roller. A pattern on the patterned roller can be a pattern of very fine lines; for example, 100–350 lines per inch, arranged along a certain oblique direction, a pattern of obliquely crossing lines, or a like pattern. When toner has sufficient fluidity, a toner layer which is formed on the developing roller according to a fine pattern becomes a level layer as effected by its own leveling function before the blade is reached. When the fluidity of toner is poor, the patterned toner layer does not level and undergoes cohesion effected by a blade bias. As a result, a pattern formed on the patterned roller appears on an image.

Thus, preferably, toner is adjusted to have sufficiently low surface tension and sufficient fluidity such that toner which is applied onto the developing roller according to a pattern formed on the patterned roller becomes level before the toner reaches the conductive blade while being conveyed on the rotating developing roller.

Fluidity of toner depends on solid concentration and is set to not greater than 30%, preferably not greater than 20%. The thickness of a toner layer on the developing roller depends on the number of pattern lines of the patterned roller and varies with toner viscosity. The thickness of a toner layer is about 12 $\mu$m at 100 LPI (100 lines per inch), about 10 $\mu$m at 160 LPI, and about 7 $\mu$m at 250 LPI.

The amount of solid which is sufficient for satisfaction of image density is determined. For example, the required amount of solid per unit area is 1 g/m$^2$ for cyan, 1.5 g/m$^2$ for magenta, 1.3 g/m$^2$ for yellow, and 1.5 g/m$^2$ for black. When the solid concentration of toner is set to not greater than 20% as mentioned above, a minimal toner layer thickness for satisfying the requirements for the amount of solid is determined.

From the viewpoint of image quality, the thinner the toner layer thickness, the better. When a toner layer is excessively thick at a nip section where the developing roller and a photosensitive drum effect nipping, an image is disturbed. The degree of image disturbance increases as the toner layer thickness increases, as toner viscosity decreases, or as the hardness of the developing roller increases. Thus, the toner layer thickness is set to not greater than 10 $\mu$m, preferably not greater than 7 $\mu$m.

Preferably, the toner storage tank or the toner supply bottle is equipped with a heater for maintaining toner at a constant temperature, to thereby maintain toner transfer from the patterned roller at a constant rate.

Industrial Applicability

As described above, according to the present invention, a conductive blade which comes into contact with a liquid toner layer on a developer bearer body is provided such that a predetermined amount of liquid toner passes through a gap between the conductive blade and the developer bearer body; and voltage is applied to the conductive blade so as to establish a state such that toner particles contained in the liquid toner are sparsely scattered in a surface region of a level, thin toner layer on the developer bearer body. Thus, an unnecessarily high degree of toner cohesion is not caused, and disturbance of the toner layer due to liquid viscosity is suppressed, to thereby form a level, transparent oil layer at a surface region of the toner layer. Furthermore, the resultant toner layer is brought into contact with an image bearer body to thereby perform development, whereby an image of high quality can be obtained.

The present invention enables reduction in apparatus size through omission of a prewetting system.

According to the present invention, a thin toner layer is applied uniformly at a position located upstream of a member for applying an electric field, to thereby perform development effectively.

What is claimed is:

1. A liquid-development electrophotographic apparatus having a developer bearer body which is in contact with an image bearer body having an electrostatic latent image formed thereon so as to supply a liquid toner serving as a liquid developer onto the image bearer body and which causes toner particles contained in the liquid developer to adhere to the image bearer body according to an electric field established between the same and the image bearer body to thereby form a toner image, comprising:

a conveyor to apply the liquid toner onto said developer bearer body; and a conductive member to operatively come into contact with a liquid toner layer on said developer bearer body, wherein said conductive member assumes such flexibility as to allow passage of a predetermined amount of liquid toner without the toner layer being scraped between the same and said developer bearer body, such that voltage is applied to said conductive member so as to bring a surface region of the toner layer on said developer bearer body to a state such that toner particles contained in the liquid toner are sparsely scattered, and the resultant liquid toner is brought into contact with the image bearer body for performing development.

2. The liquid-development electrophotographic apparatus of claim 1, wherein said conductive member assumes the form of a blade having flexibility and is disposed such that an end of the blade is in contact with said developer bearer body while maintaining a sufficient width of nip effected together with said developer bearer body.

3. The liquid-development electrophotographic apparatus of claim 2, wherein said conductive member is made of a material of low thermal expansion coefficient.

4. The liquid-development electrophotographic apparatus of claim 1, wherein said conductive member is in contact with said developer bearer body at such a position that a surface region of the toner layer can maintain a state such that toner particles are sparsely scattered, in the course of travel of the toner layer over a distance between the position and a development position.

5. The liquid-development electrophotographic apparatus of claim 1, wherein, in order to ensure levelness of a thin toner layer, a leveling blade is disposed upstream of a position where said conductive member is disposed.

6. The liquid-development electrophotographic apparatus of claim 1, wherein said conductive member assumes a resistance of not greater than $10^4$ Ω, and voltage is applied to said conductive member via a current limiter resistor.

7. The liquid-development electrophotographic apparatus of claim 6, wherein a voltage drop associated with current flowing to said conductive member is checked, and a bias applied to said conductive member is varied such that an effective voltage applied to toner present between said conductive member and said developer bearer body is constant at all times.

8. The liquid-development electrophotographic apparatus of claim 1, wherein a patterned roller is disposed upstream of said developer bearer body while abutting said developer bearer body, and adapted to convey and supply the liquid toner onto said developer bearer body; and said conductive member is caused to come into contact with a toner layer supplied from the patterned roller to said developer bearer body.

9. The liquid-development electrophotographic apparatus of claim 1, wherein, in order to uniformly apply the liquid toner onto said developer bearer body, a patterned roller is equipped with a blade for scraping off excessive liquid toner before the liquid toner is supplied to said developer bearer body, such that the liquid toner is present merely in pattern grooves of the patterned roller so as to prevent continuous generation of riblets at an exit of a nip section where said developer bearer body and the patterned roller effect nipping; and the liquid toner is adjusted to assume sufficiently low surface tension and sufficient fluidity such that the liquid toner which is applied onto said developer bearer body according to a pattern formed on the patterned roller becomes level before the liquid toner reaches said conductive member while being conveyed on said developer bearer body which is rotating.

10. An electrophotographic apparatus, comprising:

a conveyor to apply liquid toner onto a developer bearer body; and a conductive member to operatively contact a liquid toner layer on the developer bearer body, wherein said conductive member assumes such flexibility as to allow passage of a predetermined amount of the liquid toner between the same and the developer bearer body, such that voltage is applied to said conductive member so as to bring a surface region of the toner layer on the developer bearer body to a state such that toner particles contained in the liquid toner are sparsely scattered, and the resultant liquid toner is brought into contact with an image bearer body for performing development, and wherein said conductive member assumes a resistance of not greater than $10^4$ Ω, and voltage is applied to said conductive member via a current limiter resistor.

11. The electrophotographic apparatus of claim 10, wherein a voltage drop associated with current flowing to the conductive member is checked, and a bias applied to the conductive member is varied such that an effective voltage applied to toner present between the conductive member and the developer bearer body is constant at all times.

12. An electrophotographic apparatus, comprising:

a conveyor to apply liquid toner onto a developer bearer body; and a conductive member to operatively contact a liquid toner layer on the developer bearer body, wherein said conductive member assumes such flexibility as to allow passage of a predetermined amount of the liquid toner between the same and the developer bearer body, such that voltage is applied to said conductive member so as to bring a surface region of the toner layer on the developer bearer body to a state such that toner particles contained in the liquid toner are sparsely scattered, and the resultant liquid toner is brought into contact with an image bearer body for performing development, and wherein said conductive member assumes the form of a blade having flexibility and is disposed such that an end of the blade is in contact with said developer bearer body while maintaining a sufficient width of nip effected together with said developer bearer body, and is made of a material of low thermal expansion coefficient.

13. An electrophotographic apparatus, comprising:

a conveyor to apply liquid toner onto a developer bearer body; and a conductive member to operatively contact a liquid toner layer on the developer bearer body, wherein said conductive member assumes such flexibility as to allow passage of a predetermined amount of the liquid toner between the same and the developer bearer body, such that voltage is applied to said conductive member so as to bring a surface region of the toner layer on the developer bearer body to a state such that toner particles contained in the liquid toner are sparsely scattered, and the resultant liquid toner is brought into contact with an image bearer body for performing development, and wherein, in order to uniformly apply the liquid toner onto the developer bearer body, a patterned roller is equipped with a blade for scraping off excessive liquid toner before the liquid toner is supplied to the developer bearer body, such that the liquid toner is present merely in pattern grooves of the patterned roller so as to prevent continuous generation of riblets at an exit of a nip section where the developer bearer body and the patterned roller effect nipping; and the liquid toner is adjusted to assume sufficiently low surface tension and sufficient fluidity such that the liquid toner which is applied onto the developer bearer body according to a pattern formed on the patterned roller becomes level before the liquid toner reaches the conductive member while being conveyed on the developer bearer body which is rotating.

* * * * *

UNITED STATES PATENT AND TRADEMARK OFFICE

CERTIFICATE OF CORRECTION

PATENT NO. : 6,571,075 B2
DATED : May 27, 2003
INVENTOR(S) : Yutaka Nakashima et al.

It is certified that error appears in the above-identified patent and that said Letters Patent is hereby corrected as shown below:

Title page,
Item [75], Inventors, after "Sakai, Kanazawa (JP)" delete ", onaga";
Item [30], Foreign Application Priority Data, change "May 15, 2001" to -- May 16, 2000 --.

Signed and Sealed this

Twenty-third Day of March, 2004

JON W. DUDAS
*Acting Director of the United States Patent and Trademark Office*